US006984273B1

(12) United States Patent
Martin et al.

(10) Patent No.: US 6,984,273 B1
(45) Date of Patent: Jan. 10, 2006

(54) PREMIXED LIQUID MONOPROPELLANT SOLUTIONS AND MIXTURES

(75) Inventors: James D Martin, Manassas, VA (US); Norman H Lundstrom, Manassas, VA (US); Robert S. Scheffe, Lorton, VA (US)

(73) Assignee: Aerojet-General Corporation, Redmond, WA (US)

( * ) Notice: Subject to any disclaimer, the term of this patent is extended or adjusted under 35 U.S.C. 154(b) by 348 days.

(21) Appl. No.: 09/363,013

(22) Filed: Jul. 29, 1999

(51) Int. Cl.
*C06B 47/00* (2006.01)

(52) U.S. Cl. ..... 149/1

(58) Field of Classification Search ..... 149/45, 149/1; 60/219, 218, 214, 210, 215, 216
See application file for complete search history.

(56) References Cited

U.S. PATENT DOCUMENTS

| | | | | | |
|---|---|---|---|---|---|
| 2,896,407 | A | | 7/1959 | Zletz et al. | 149/46 |
| 3,004,842 | A | | 10/1961 | Rowlinson | 149/17 |
| 3,020,708 | A | * | 2/1962 | Mahan | 60/215 |
| 3,036,940 | A | * | 5/1962 | Fletcher | 149/78 |
| 3,072,020 | A | * | 1/1963 | Barnes et al. | 89/1.819 |
| 3,143,446 | A | | 8/1964 | Berman | 149/2 |
| 3,470,040 | A | | 9/1969 | Tarpley, Jr. | 149/17 |
| 3,662,555 | A | * | 5/1972 | Ayers et al. | 149/2 |
| 3,700,393 | A | * | 10/1972 | Mueller | 149/75 |
| 3,797,392 | A | * | 3/1974 | Eckels | 102/23 |
| 4,047,988 | A | * | 9/1977 | Weill et al. | 149/74 |
| 4,294,633 | A | * | 10/1981 | Clay | 149/2 |
| 4,527,389 | A | | 7/1985 | Biddle et al. | 60/207 |
| 4,698,105 | A | * | 10/1987 | Inoue et al. | 149/2 |
| 4,822,433 | A | * | 4/1989 | Cooper et al. | 149/2 |
| 4,942,800 | A | * | 7/1990 | Bouillet et al. | 86/20.1 |
| 5,292,387 | A | | 3/1994 | Highsmith et al. | 149/19.1 |
| 5,565,150 | A | * | 10/1996 | Dillehay et al. | 264/3.3 |
| 5,727,368 | A | * | 3/1998 | Wernimont et al. | 60/218 |
| 5,837,931 | A | | 11/1998 | Bruenner et al. | 149/109.6 |
| H1768 | H | * | 1/1999 | Mueller et al. | 149/46 |
| 5,932,837 | A | * | 8/1999 | Rusek et al. | 149/1 |
| 5,972,136 | A | * | 10/1999 | Wagaman | 149/46 |
| 5,976,483 | A | * | 11/1999 | Langlet et al. | 423/385 |

FOREIGN PATENT DOCUMENTS

| | | | |
|---|---|---|---|
| JP | 56014584 | * | 2/1981 |
| JP | 02099662 | * | 4/1990 |
| JP | 07315345 | * | 12/1995 |

OTHER PUBLICATIONS

Article by P.R. Stokes entitled "Hydrogen Peroxide for Power and Propulsion", read at the Science Museum in London on Jan. 14, 1998.*
Article by Harold N. Feigenbaum et al. entitled "Practical Experiences with High Test Hydrogen Peroxide." Publication date unknown.*
Browser indicates last modified on Oct. 26, 1998.*
Japanese published patent document 56014584A, published Feb. 12, 1981.*
Japanese published patent document 02099662A, published Apr. 11, 1990.*
Japanese published patent document 07315345A, published Dec. 5, 1995.*
Article by P.R. Stokes entitled "Hydrogen Peroxide for Power and Propulsion," read at the Science Museum in London on Jan. 14, 1998.*

* cited by examiner

*Primary Examiner*—Aileen Felton
(74) *Attorney, Agent, or Firm*—Nixon & Vanderhye, P.C.

(57) ABSTRACT

Nondetonable, or low detonation sensitivity, substantially nontoxic liquid monopropellants are provided. The liquid propellants are formed from aqueous solutions of solid oxidizers in liquid oxidizers and water soluble liquid fuels and formulated to have a freezing point less than −10° C. Liquid oxidizers may be inorganic or organic aqueous solutions, with hydrogen peroxide being preferred. Preferred solid oxidizers are water soluble nitrates including ammonium dinitramide, aminoguanidine dinitrate, ammonium nitrate, hydroxylamine nitrate, hydrazine nitrate, guanidine nitrate and aminoguanidine nitrate. Preferred liquid fuels are water soluble alcohols, amines and amine nitrates, hydroxyethyl hydrazine, hydroxyethylhydrazine nitrate, cyanoguanidine, guanidines, aminoguanidines, triaminoguanidines, and their nitrate salts, ethanolamine dinitrate, ethylenediamine dinitrate, polyvinyl nitrate, and aziridine.

8 Claims, No Drawings

PREMIXED LIQUID MONOPROPELLANT SOLUTIONS AND MIXTURES

TECHNICAL FIELD

The present invention relates generally to premixed liquid monopropellant compositions and specifically to nondetonable premixed liquid monopropellant mixtures and solutions consisting of oxidizers and fuels.

BACKGROUND OF THE INVENTION

Recent requirements for "green" or substantially less toxic rocket propellants, particularly for use on space stations, have resulted in a search for suitable less toxic propellant compositions that function as effectively as available propellants. Solid rocket propellants are fast burning solids which operate only one time and are not usable in, for example, space station and similar applications where throttle control and on/off switching capability are essential. Liquid propellants provide the throttle and switching control desired for thrust vector control motors. An oxidizer of nitrogen tetroxide with a fuel of hydrazine is an excellent bipropellant combination for this purpose. Hydrazine used as a monopropellant is also attractive for this purpose. Also, catalyzed hydrazine as a monopropellant provides off/on capability. However, these propellants do not conform to the new requirements for environmentally nontoxic propellants because the constituents are extremely toxic or carcinogenic.

Most of the available liquid propellants are bipropellants similar to nitrogen tetroxide and hydrazine discussed above. The liquid oxidizer and the liquid fuel components are stored separately and then mixed when the propellant must be burned. In some cases the ingredients used in bipropellant systems are hypergolic. A hypergolic bipropellant system is one in which the constituents ignite on contact with each other. Although liquid monopropellants are simpler to use than bipropellants, liquid monopropellants that perform as w II as liquid bipropellants have heretofore not been available.

Liquid propellants, many of which have been claimed to have less toxicity, have been disclosed as green propellants, in the prior art. Zletz et al. In U.S. Pat. No. 2,896,407, for example, disclose liquid propellants useful for gas generation and rocket propulsion. The bipropellants disclosed by Zletz et al. require the hypergolic reaction of a liquid fuel and a liquid oxidizer, preferably highly concentrated hydrogen peroxide that may optionally include a dissolved water soluble inorganic salt, such as ammonium nitrate. The hypergolic fuel is an organohalothioborate, such as dimethylchlorodithioborate or its solutions in conventional hydrocarbons. Zletz et al. do not disclose or otherwise suggest premixed monopropellant mixtures or solutions containing water soluble organics, such as alcohols, or water soluble organic salts, such as amine-nitrates, in aqueous hydrogen peroxide solutions. Furthermore, it is not possible to forecast the behavior of four-component mixtures, such as $H_2O_2$/$H_2O$/AN/alcohol, based on the properties of three-component mixtures such as $H_2O_2$/$H_2O$/AN. Moreover, the hypergolic bipropellant formulations described by Zletz et al. are, by their nature, unsuitable for use as monopropellants.

Rowlinson. U.S. Pat. No. 3,004,842 teaches that foamed solid AN explosives are more sensitive to detonation than either unfoamed or porous beds of granules. He melt-casts compositions containing AN at the melting point of AN, and uses $H_2O_2$ as a foaming agent that decomposes to steam and $O_2$ at the casting temperature, forming a solid foam as the temperature is lowered to ambient. His foams are detonable with only a blasting cap and do not require a booster like other AN explosives.

The present invention concerns only liquid solutions and mixtures. Rowlinson uses $H_2O_2$ as a foaming agent, not as either a solute or an oxidizer. Also, preferably our monopropellants would be nondetonable.

U.S. Pat. No. 3,470,040 to Tarpley describes inorganic liquid propellant compositions that are essentially unpourable, and thus are gel-like, under storage or shear conditions. These gelled liquid propellants may use a liquid oxidizer, such as red fuming nitric acid and liquid oxygen, and contain ammonium nitrate, have a yield point and flow when pumped. The present invention discloses premixed liquid monopropellant solutions and mixtures and not gels.

Berman, in U.S. Pat. No. 3,143,446, acknowledges the disadvantages of all liquid propellant types of rocket motors and teaches encapsulating reactive liquid oxidizers, including nitrogen tetroxide, or liquid fuels, such as hydrazine, for use in solid propellants. Auxiliary solid oxidizers, such as ammonium nitrate, may be used with the encapsulated liquids. The present invention does not disclose encapsulated propellant ingredients.

Hybrid propellants consisting of a solid fuel, either RDX or HMX, and a liquid oxidizer are taught by Biddle et al. in U.S. Pat. No. 4,527,389. The liquid oxidizer preferred for this purpose is an aqueous solution of hydroxylamine nitrate (HAN) or hydroxylamine perchlorate (HAP). The solid fuel burns by itself to generate fuel-rich combustion products, and the liquid oxidizer is sprayed into the combustion products to oxidize them to completion. Biddle does not disclose premixed liquid monopropellants. Use of hydrogen peroxide as an oxidizer is stated to be unsuitable because it is corrosive. The present invention does not disclose propellants for use in a hybrid rocket motor configuration.

U.S. Pat. No. 5,292,387 to Highsmith et al. discloses ammonium nitrate-containing propellants. These propellants, however, are solid propellants wherein ammonium nitrate is phase-stabilized with a metal dinitramide, preferably potassium dinitramide by dissolving ammonium nitrate and potassium dinitramide in methanol, which is evaporated. It is not suggested that any of these components could be used to form premixed liquid monopropellant solutions and mixtures.

In U.S. Pat. No. 5,837,931, Bruenner et al. disclose solid solutions made of ammonium nitrate, hydrazinium nitrate, hydroxylammonium nitrate and/or lithium nitrate, including eutectics, that are liquid at room temperature and useful as liquid oxidizers for propellants. These propellants, which contain a metal fuel, a hydrocarbon polymer and the liquid oxidizer, form a gel structure that supports the metal fuel. Bruenner et al. does not suggest liquid propellants that do not require the formation of solid solutions or eutectics.

A need exists, therefore, for substantially nontoxic, low detonation sensitivity, environmentally friendly liquid propellants that perform effectively and provide maximum throttle control. A need particularly exists for premixed liquid monopropellant solutions and mixtures with these characteristics.

SUMMARY OF THE INVENTION

It is a primary object of the present invention, therefore, to overcome the disadvantages of the prior art and to provide substantially nontoxic, or less toxic, nondetonable, environmentally friendly liquid propellants that perform as effectively as hydrazine monopropellants and/or liquid bipropellants.

It is another object of the present invention to provide a substantially nontoxic, nondetonable or low detonation susceptible, environmentally friendly liquid monopropellant with a "start-stop-start" capability that fulfills a mission requirement as effectively as a Bipropellant system in which the oxidizer and fuel constituents are stored in separate tanks.

It is yet another object of the present invention to provide a low toxicity, non-carcinogenic, smokeless, safe liquid monopropellant useful for impulse propellants and gas generators.

It is yet a further object of the present invention to provide throttleable premixed liquid monopropellant solutions and mixtures which can be readily decomposed or combusted by contact with a catalyst pack or ignited with the use of a glow plug, spark plug, or pyrotechnic squib.

It is still another object of the present invention to provide liquid monopropellants and bipropellants useful for thrust vector control motors and reaction control systems.

It is a still further object of the present invention to provide a storage stable premixed liquid propellant solution or mixture having a freezing point of less than −10° C.

In accordance with the aforesaid objects, the present invention provides substantially nontoxic, nondetonable or low detonation susceptible, environmentally friendly liquid monopropellant solutions and mixtures that perform as effectively as conventional highly toxic and reactive mono or bipropellant. The liquid propellants of the present invention are formed of aqueous solutions of selected oxidizers and selected aqueous fuels in a stoichiometrically formulated solvent/solute ratio. Preferred solvents are aqueous hydrogen peroxide solutions and/or aqueous alcohol solutions. The preferred solutes are other oxidizers and fuels. Particularly preferred other oxidizers are ammonium dinitramide, ammonium nitrate, aminoguanidine dinitrate, hydroxylamine nitrate and hydrazine nitrate. Preferred fuels are water soluble alcohols, amines, amine nitrates, polyvinyl nitrate, hydroxyethyl hydrazines, derivatives of guanidine and aminoguanidine, and azoles such as 5-aminotetrazole. Examples of preferred guanidine and aminoguanidine derivatives include guanidine nitrate, aminoguanidine nitrate, and triaminoguanidine nitrate.

Other objects and advantages will be apparent from the following detailed description and claims.

DETAILED DESCRIPTION OF THE INVENTION

The optimum operation of certain types of rockets, for example, vernier control rockets, thrust vector control motors and the like, requires maximum thrust control. The liquid propellants of the present invention provide the requisite degree of control for these applications. The liquid propellants of the pr sent invention are designed to be "throttleable". The propellant mass flow rate can be controlled with a throttle; therefore, the thrust can be controlled since the specific impulse times the mass flow rate is equal to the thrust. Unlike solid propellant systems, the decomposition or combustion of the liquid monopropellant mixtures and solutions of the present invention may be switched on or off to provide further control. In a rocket propulsion system or specifically a thrust vector control motor, the combustion or decomposition of the liquid monopropellant mixtures and solutions of the present invention may be controlled so thrust is throttled up gradually, and power may be switched off or on, as necessary. The premixed liquid monopropellant mixtures and solutions of the present invention are more versatile than solid propellants because of their control capability. Solid propellants burn quickly and produce maximum thrust quickly, while liquid propellants can be throttled to increase thrust gradually.

The unique composition of the premixed liquid monopropellant mixtures and solutions of the present invention is responsible for the foregoing characteristics. The novel liquid monopropellants are formulated from solutions of oxidizers and fuels. Aqueous hydrogen peroxide solutions and/or aqueous organic solutions, particularly alcohol solutions, are the solvents of choice for the present liquid propellants. Solutions with nitric acid and other water soluble nitrates may also be used, however. The solutes preferred for these propellants are solid oxidizers and fuels. Methanol and ethanol solutions are the preferred alcohol solutions. Preferred solid oxidizers include ammonium dinitramide (ADN), ammonium nitrate (AN), hydroxylamine nitrate (HAN), hydrazine nitrate (HN) and aminoguanidine binitrate. Other similar water soluble oxidizers may also be useful in this propellant formulation.

The fuels preferred for the premixed liquid monopropellant solutions and mixtures of the present invention should be aqueous hydrocarbons, aqueous nitro-organics and solutions of solid organic fuel compounds in these liquids. Additional preferred fuels include water soluble alcohols, amines, amine nitrates such as triaminoguanidine nitrate (TAGN), hydroxyethyl hydrazine, hydroxyethyl hydrazine nitrate, guanidine nitrate and, aminoguanidine nitrate, and mixtures thereof.

A premixed liquid monopropellant formulation in accordance with the present invention may be made by dissolving a selected solid oxidizer in aqueous hydrogen peroxide. A preferred solid oxidizer is ammonium dinitramide. Both methanol and ethanol are miscible in the $ADN/H_2O_2/H_2O$ solution. The solvent/solute ratio is preferably formulated to be at the stoichiometric point relative to carbon dioxide ($CO_2$) and water ($H_2O$) plus or minus about 5%. Sufficient water may be added to maintain the desired flame temperature.

Equation 1 illustrates a typical premixed monopropellant oxidizer fuel mixture reaction in accordance with the present invention:

$$CH_3CH_2OH+6H_2O_2+3H_2O \rightarrow 2CO_2+9H_2O$$

This formulation achieves the objectives of the present invention with 80% $H_2O_2$, 12% $CH_3CH_2OH$ and 8% $H_2O$. The $H_2O_2$ is preferably at a 70% concentration in water. The low concentration of $H_2O_2$ (70%) allows the use of commercially available, easily handled material. In accordance with the invention, a range of $H_2O_2$ concentration from 40%–90% may be used.

The liquid propellant mixtures and solutions of the present invention are ideally nondetonable or have low detonation susceptibility and are formulated to have a flame temperature which meet the gas generator or rocket motor design requirements. The premixed liquid monopropellant mixture must ignite reliably and repeatedly when required to do so. For example, repeatable ignition of the liquid monopropellant can be achieved with decomposition on a catalyst bed such as iridium, silver, silver oxide or platinum. Other methods suitable include the use of a glow plug, spark plug, or separately stored chemical ingredient, which when mixed with the liquid monopropellant results in hypergolic ignition.

It is necessary for the freezing point of the propellants of the present invention to be less than −10° C. to perform properly.

An alternate route to improved performance is to dissolve a solid oxidizer, such as, for example, aminoguanidine nitrate, ammonium nitrate or ammonium dinitramide, in the aqueous mixture, thus increasing the specific gravity, which, in turn, increases performance. In general, it is desired that the specific gravity of the propellant be as high as possible for maximum performance, the goal being to maximize the specific gravity within the constraints imposed by the freezing point and storage stability.

The maximum desirable upper storage temperature limit is about 71° C. (160° F.). If necessary, stabilizers may be added to enable the propellant liquid to withstand storage.

An advantage presented by the premixed liquid monopropellant solutions and mixtures of the present invention is their requirement for only one storage tank, one pump and one controller as compared to the dual components necessary for the separate fuel and oxidizer solutions of a bipropellant propulsion system. High performance premixed monopropellant mixtures and solutions as disclosed in the present invention provide the capability for achieving performance levels greater than conventional monopropellants such as anhydrous hydrazine for use in gas generators, and in fact, in some cases, are comparable in performance to conventional bipropellants used in very high performance rocket systems.

Table 1 below describes the characteristics of seven liquid monopropellant compositions made in accordance with the present invention.

Premixed liquid monopropellant mixtures and solutions consisting of a variety of fuels mixed with 70% hydrogen peroxide were theoretically evaluated and compared with a baseline of anhydrous hydrazine, a conventional monopropellant. In addition to comparison with a conventional monopropellant system, examples of the premixed liquid monopropellants of the present invention were also compared with a bipropellant system consisting of nitrogen tetroxide and monomethyl hydrazine (NTO/MMH). Flame temperatures were held at 2000° K or less. A flame temperature ceiling of 2000° K was considered the upper limit for use with SOA materials used for construction of combustors and perceived catalyst beds. The basis that was used for comparison of performance is relative boost velocity, V. REL. It can be shown that the theoretical boost velocity (V Boost) of a missile is $$V\text{Boost}=Ivac\cdot gc\cdot In[1+RHO/(Mi/Vp)], \quad (1)$$

where

Ivac=vacuum specific impulse @ a combustion pressure ($P_c$) of 125 psia and an expansion ratio (ϵ) of 180.

| | |
|---|---|
| gc = | Newton's constant, |
| RHO = | propellant density, |
| Mi = | mass of inert parts, and |
| Vp = | volume of propellant |

Using relative boost velocity, defined as $$V.REL = \frac{(V\ \text{Boost})\ \text{of candidate Propellant}}{(V\ \text{Boost})\ \text{of baseline Propellant}} \quad (2)$$

as the figure of merit, the candidates were compared at three assigned values of Mi/Np to the baseline monopropellant, hydrazine, and baseline bipropellant (NTO/MMH).

TABLE I

| | Examples of Premix d Liquid Monopropellant Solutions and Mixtures | | | | | | |
|---|---|---|---|---|---|---|---|
| Composition | A | B | C | D | E | F | G |
| 70% $H_2O_2$ | 59.86 | 84.00 | 80.00 | 80.00 | 77.00 | 77.00 | 36.67 |
| ADN | — | — | — | — | — | — | 51.20 |
| AN | 25.00 | — | — | — | — | — | — |
| Ethanol | 15.14 | 16.00 | 12.00 | 20.00 | 20.00 | 18.00 | 12.13 |
| Water | — | — | 8.00 | — | 3.00 | 5.00 | — |
| Freezing Point ° C. | <−10 | <−10 | <−10 | <−10 | — | — | <−10 |
| Flame Temp, ° K | 2000 | 2000 | 1900 | 1817 | 1713 | 1756 | 2542 |
| IVAC | 276.0 | 279.6 | 273.1 | 270.0 | 264.8 | 266.9 | 307.7 |
| Density (rho) | .0450 | .0422 | .0423 | .0413 | .0410 | .0412 | .0503 |
| | PERFORMANCE COMPARED TO NTO/MMH: Relative Boost Velocity Compared With Baseline Bipropellant (NTO/MMH) | | | | | | |
| mf = 0.1 | 0.81 | 0.77 | — | — | 0.71 | 0.72 | 1.00 |
| mf = 0.5 | 0.80 | 0.77 | — | — | 0.72 | 0.73 | 0.96 |
| mf = 0.9 | 0.79 | 0.78 | — | — | 0.73 | 0.74 | 0.92 |
| | PERFORMANCE COMPARED TO ANHYDROUS HYDRAZINE: Relative Boost Velocity Compared With Baseline Monopropellant (ANHYDROUS HYDRAZINE) | | | | | | |
| mf = 0.1 | 1.53 | 1.46 | 1.42 | 1.38 | 1.34 | 1.36 | 1.88 |
| mf = 0.5 | 1.45 | 1.41 | 1.38 | 1.34 | 1.30 | 1.32 | 1.75 |
| mf = 0.9 | 1.36 | 1.34 | 1.31 | 1.29 | 1.26 | 1.27 | 1.58 |

TABLE I-continued

| Composition | Examples of Premix d Liquid Monopropellant Solutions and Mixtures | | | | | | |
|---|---|---|---|---|---|---|---|
| | A | B | C | D | E | F | G |
| | | | HAZARDS | | | | |
| (Impact, Friction, Electrostatic) | Acceptable | Acceptable | Acceptable | Acceptable | — | — | Acceptable |
| Detonation #8 Cap | yes | yes | no | yes | — | — | — |
| NOL card gap test @ 70 cards | — | — | Negative | — | — | — | — |
| Explosive Classification | — | — | Class 1.3 | — | — | — | — |

TABLE II

Monopropellant Compositions With Values of Relative Boost Velocity Similar to High Performance NTO/MMH Bipropellant Systems

| Composition, Wt% | | | | | $U_{REL}$ @ $(m_f)_{N2O4/MMH}$ = | | |
|---|---|---|---|---|---|---|---|
| Oxidizer | Fuel | Ivac | $T_c$, ° K | RHO | 0.1 | 0.5 | 0.9 |
| 44 HP 70% | 56 GN | 271.0* | 2149 | 0.04953 | 0.87 | 0.84 | 0.80 |
| 50 HP 70% | 50 GN | 260.8 | 2018 | 0.04902 | 0.83 | 0.80 | 0.77 |
| 38 HP 90% | 62 GN | 287.5* | 2381 | 0.05138 | 0.95 | 0.92 | 0.86 |
| 50 HP 90% | 50 GN | 269.3 | 2176 | 0.05122 | 0.89 | 0.86 | 0.81 |
| 47 HP 70% | 53 AGN | 276.9* | 2194 | 0.05178 | 0.93 | 0.89 | 0.83 |
| 50 HP 70% | 50 AGN | 271.0 | 2132 | 0.05145 | 0.90 | 0.86 | 0.81 |
| 41 HP 90% | 59 AGN | 294.5* | 2438 | 0.05451 | 1.03 | 0.98 | 0.90 |
| 50 HP 90% | 50 AGN | 279.2 | 2284 | 0.05387 | 0.97 | 0.92 | 0.85 |
| 50 HP 70% | 50 TAGNO3 | 300.2* | 2433 | 0.05061 | 0.98 | 0.94 | 0.90 |
| 44 HP 90% | 56 TAGNO3 | 320.1* | 2669 | 0.05325 | 1.10 | 1.04 | 0.97 |
| 50 HP 90% | 50 TAGNO3 | 308.5 | 2584 | 0.05295 | 1.05 | 1.00 | 0.94 |
| 68 HP 70% | 32 TAGN3 | 300.2* | 2381 | 0.04811 | 0.94 | 0.91 | 0.88 |
| 62 HP 90% | 38 TAGN3 | 327.8* | 2709 | 0.05112 | 1.08 | 1.04 | 0.98 |
| 77 HP 70% | 23 GCN | 277.1* | 2167 | 0.04738 | 0.85 | 0.83 | 0.81 |
| 73 HP 90% | 27 GCN | 308.3* | 2550 | 0.05062 | 1.01 | 0.97 | 0.92 |
| 88 HP 70% | 12 ETNH | 299.6* | 2310 | 0.04361 | 0.85 | 0.85 | 0.84 |
| 85 HP 90% | 15 ETNH | 334.8* | 2698 | 0.04588 | 1.00 | 0.98 | 0.96 |
| 82 HP 70% | 18 NO2ACANID | 289.2* | 2296 | 0.04726 | 0.89 | 0.87 | 0.84 |
| 78 HP 90% | 22 NO2ACANID | 320.1* | 2669 | 0.05073 | 1.05 | 1.01 | 0.96 |
| 44 HP 70% | 56 EDDN | 291.4 | 2356 | 0.05182 | 0.98 | 0.93 | 0.88 |
| 28 HP 70% | 72 EOADN | 306.9 | 2628 | 0.05249 | 1.04 | 0.99 | 0.93 |
| 55 HP 70% | 45 $PVNO_3$ | 313.2 | 2660 | 0.05094 | 1.03 | 0.99 | 0.94 |

NOTE:
*Denotes maximum Ivac @ $P_c$ = 125 PSIA & $\epsilon$ = 180
GN is guanidine nitrate
AGN is aminoguanidine nitrate
TAGNO3 is triaminoguanidine nitrate
GCN is cyanoguanidine
ETNH is aziridine (ethylene imine, $H_3CCH(=NH)$
NO2ACANID is nitroacetanilide ($NO_2C_6H_4NH(C=O)CH_3$
EDDN is ethylene diamine dinitrate
EOADN is ethanolamine dinitrate
$PVNO_3$ is polyvinyl nitrate
HP 70% is an aqueous solution containing 70% hydrogen peroxide
HP 90% is 90% hydrogen peroxide As described above, the performance of th liquid monopropellants described in Table I was evaluated relative to a baseline nitrogen tetroxide and monomethylhydrazine (NTO/MMH) bipropellant and a baseline anhydrous hydrazine monopropellant. The theoretical boost velocities of the monopropellant compositions A, B, E, F, and G were computed relative to a baseline bipropellant composed of 62% NTO and 38% MMH, at baseline mass fractions of 0.1, 0.5 and 0.9 mass fraction. Also, the relative boost velocities of monopropellant. Compositions A, B, C, D, E, F and G were compared to that of the baseline monopropellant anhydrous hydrazine at 0.1, 0.5, and 0.9 mass fraction.

Hazards testing was conducted on Compositions A, B, C and D. In particular impact, friction and electrostatic data were evaluated and found to be acceptable. Detonation tests with a Number 8 cap were run on a variety of formulations. The Composition C formulation was nondetonable. This composition was also Class 1.3 in the NOL card gap test.

In accordance with the present invention Table 2 shows the theoretical performance values of Ivac ($P_c$=125 psia & $\epsilon$=180) and $V_{REL}$ (boost velocity relative to $N_2O_4$/MMH @$(m_f)_{N204/MMH}$=0.1, 0.5, and 0.9) were calculated for mixtures of either 70% HP or 90% HP and aminoguanidine nitrate (AGN), triaminoguanidine nitrate (TAGNO3, whose water solubility is only slight), TAG azide (TAGN3, whose water solubility is unknown), cyanoguanidine (GCN), aziridine (ethylene imine, ETNH), nitroacetanilide ($NO_2C_6H_4NH$ (C=O)$CH_3$, NO2ACANID), ethylene diamine dinitrate (EDDN), ethanolamine dinitrate (EOADN), and polyvinyl nitrate (PVNO3). Results are attached. They are all either maxima in terms of $V_{REL}$, and usually in terms of Ivac, or are simply 50/50 mixtures (which are estimated to be practical).

The best fuel was PVNO3. It and EOADN were the only fuels that were superior to the baseline with 70% HP as the oxidizer.

INDUSTRIAL APPLICABILITY

The liquid monopropellants of the present invention will find their primary applicability as safe, nontoxic smokeless impulse propellants and gas generators in applications such as thrust vector control motors.

What is claimed is:

1. A premixed liquid monopropellant which consists of an aqueous mixture of hydrogen peroxide, ethanol, and water in an amount sufficient to render the monopropellant nondetonable and to maintain a flame temperature when ignited of about 2000° K or less.

2. The premixed liquid monopropellant of claim 1, wherein the hydrogen peroxide is present at a 70% concentration in water.

3. The premixed liquid monopropellant of claim 1, wherein the hydrogen peroxide is present in the mixture in an amount between 77% to 80%.

4. The premixed liquid monopropellant of claim 3, wherein the ethanol is present in the mixture in an amount between 12% to 20%.

5. The premixed liquid monopropellant of claim 4, wherein hydrogen peroxide is present at a 70% concentration in water, and wherein an additional amount of water is present in the mixture in an amount of between 3% to 8%.

6. A premixed liquid monopropellant which consists of 80% hydrogen peroxide having a concentration in water of 70%, 12% ethanol and 8% additional water.

7. The premixed liquid monopropellant of claim 1 or 6, which further consists of a solid oxidizer present as a solute in the liquid monopropellant.

8. The premixed liquid monopropellant of claim 7, wherein the solid oxidizer is aminoguanidine nitrate, ammonium nitrate or ammonium dinitramide.

* * * * *